US006821231B1

(12) United States Patent
Hall

(10) Patent No.: US 6,821,231 B1
(45) Date of Patent: Nov. 23, 2004

(54) BODY STRETCHING APPARATUS

(76) Inventor: Douglas A. Hall, 3787 Forest St., South Lake Tahoe, CA (US) 96150

( * ) Notice: Subject to any disclaimer, the term of this patent is extended or adjusted under 35 U.S.C. 154(b) by 161 days.

(21) Appl. No.: 10/271,310

(22) Filed: Oct. 16, 2002

(51) Int. Cl.[7] ..... A63B 71/00

(52) U.S. Cl. ..... 482/51; 482/131; 482/142; 601/34; 602/16; 602/23

(58) Field of Search ..... 482/51, 131, 142, 482/908; 602/5, 6, 10, 12, 16, 23–27; 601/23, 24, 34

(56) References Cited

U.S. PATENT DOCUMENTS 4,844,453 A * 7/1989 Hestilow ..... 482/131
4,844,454 A * 7/1989 Rogers ..... 482/131
5,122,106 A * 6/1992 Atwood et al. ..... 482/131
5,137,504 A * 8/1992 Mangini ..... 482/131
5,562,578 A * 10/1996 Guillemette ..... 482/100
5,584,756 A * 12/1996 Grapengiser et al. ..... 482/92
5,616,110 A * 4/1997 Nascimento ..... 482/131
5,904,641 A * 5/1999 Huang ..... 482/131
6,352,495 B1 * 3/2002 Hsu ..... 482/92

* cited by examiner

*Primary Examiner*—Nicholas D. Lucchesi
*Assistant Examiner*—Tam Nguyen

(57) ABSTRACT

A body stretching apparatus for stretching and strengthening muscles in the legs of the user. The body stretching apparatus includes elongate leg support members each having first and second ends and also having top and side walls; and also includes foot support assemblies being attached to the first ends of the elongate leg support members; and further includes handhold members being adjustably fastened to the elongate leg support members; and also includes leg extension assemblies being adjustably fastened to the elongate leg support members and being hingedly attached to one another; and further includes knee support assemblies being fastened to the elongate leg support members.

9 Claims, 3 Drawing Sheets

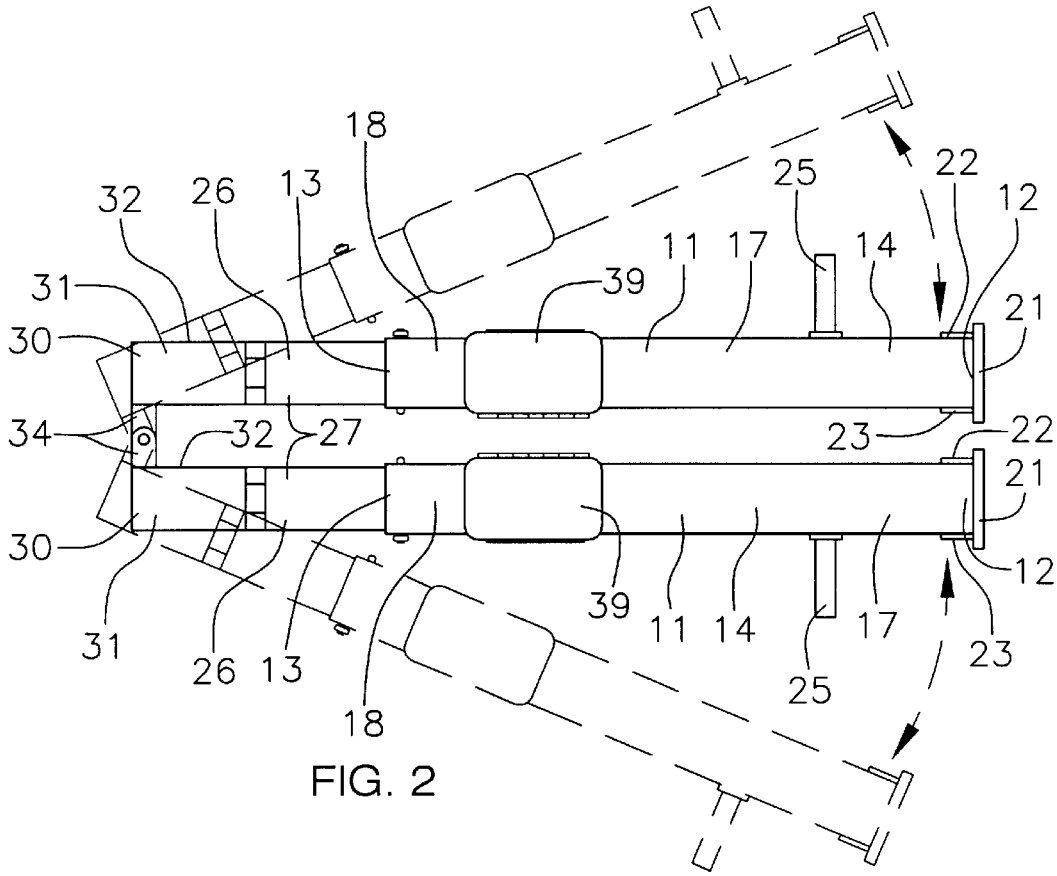
FIG. 2
FIG. 3
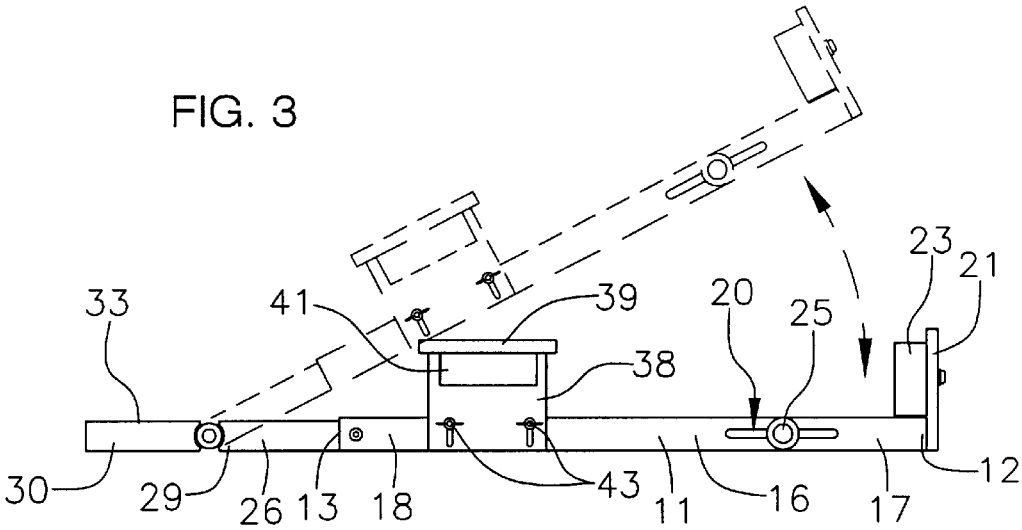

BODY STRETCHING APPARATUS

BACKGROUND OF THE INVENTION

1. Field of the Invention

The present invention relates to leg stretchers and more particularly pertains to a new body stretching apparatus for stretching and strengthening muscles in the legs of the user.

2. Description of the Prior Art

The use of leg stretchers is known in the prior art. More specifically, leg stretchers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,460,596; U.S. Pat. No. 5,584,756; U.S. Pat. No. 5,662,592; U.S. Pat. No. 6,203,473; U.S. Pat. No. 5,997,451; and U.S. Pat. No. Des. 358,435.

While these devices fulfill their respective, particular objectives and requirements, the aforementioned patents do not disclose a new body stretching apparatus. The prior art includes elongate leg members and extension members being adjustably attached to the elongate leg members.

SUMMARY OF THE INVENTION

The general purpose of the present invention, which will be described subsequently in greater detail, is to provide a new body stretching apparatus which has many of the advantages of the leg stretchers mentioned heretofore and many novel features that result in a new body stretching apparatus which is not anticipated, rendered obvious, suggested, or even implied by any of the prior art leg stretchers, either alone or in any combination thereof. The present invention includes elongate leg support members each having first and second ends and also having top and side walls; and also includes foot support assemblies being attached to the first ends of the elongate leg support members; and further includes handhold members being adjustably fastened to the elongate leg support members; and also includes leg extension assemblies being adjustably fastened to the elongate leg support members and being hingedly attached to one another; and further includes knee support assemblies being fastened to the elongate leg support members. None of the prior art includes the combination of the elements of the present invention.

There has thus been outlined, rather broadly, the more important features of the body stretching apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new body stretching apparatus which has many of the advantages of the leg stretchers mentioned heretofore and many novel features that result in a new body stretching apparatus which is not anticipated, rendered obvious, suggested, or even implied by any of the prior art leg stretchers, either alone or in any combination thereof.

Still another object of the present invention is to provide a new body stretching apparatus for stretching and strengthening muscles in the legs of the user.

Still yet another object of the present invention is to provide a new body stretching apparatus that is easy and convenient to set up and use.

Even still another object of the present invention is to provide a new body stretching apparatus that allows the user to work one's muscles to work towards preventing muscle dilapidation and atrophy.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a top plan view of the present invention.

FIG. 3 is a side elevational view of the present invention.

DESCRIPTION OF THE PREFERRED EMBODIMENT

Figure 1:
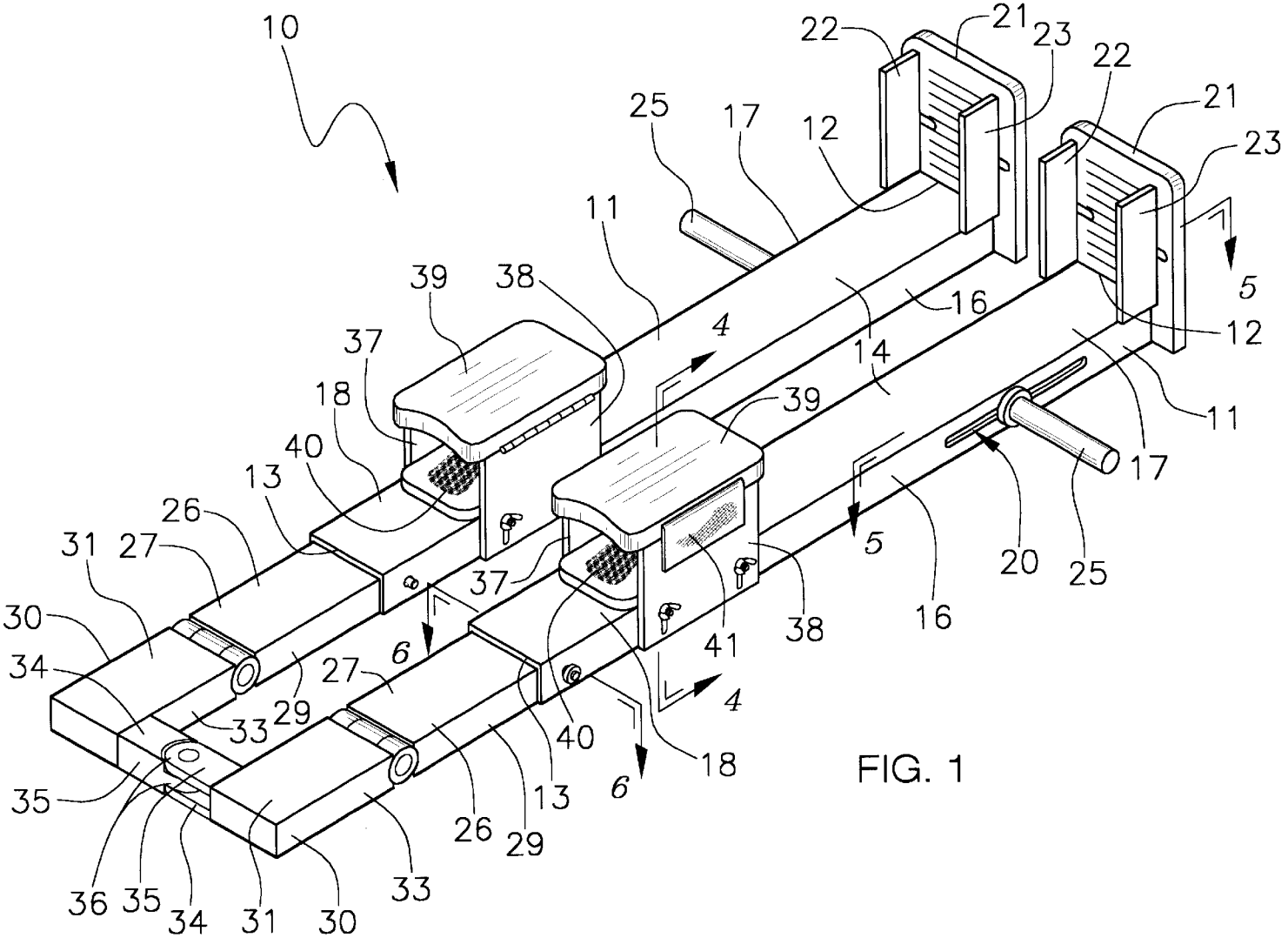
FIG. 1 is a perspective view of a new body stretching apparatus according to the present invention.
Figure 4:
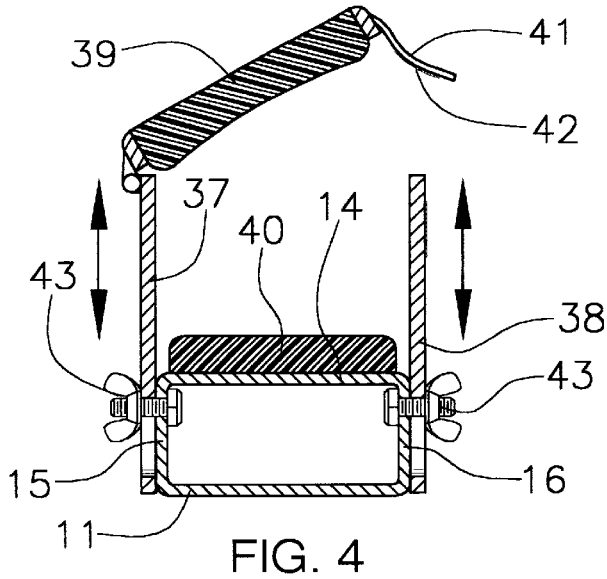
FIG. 4 is a lateral cross-sectional view of the knee support assembly of the present invention.
Figure 5:
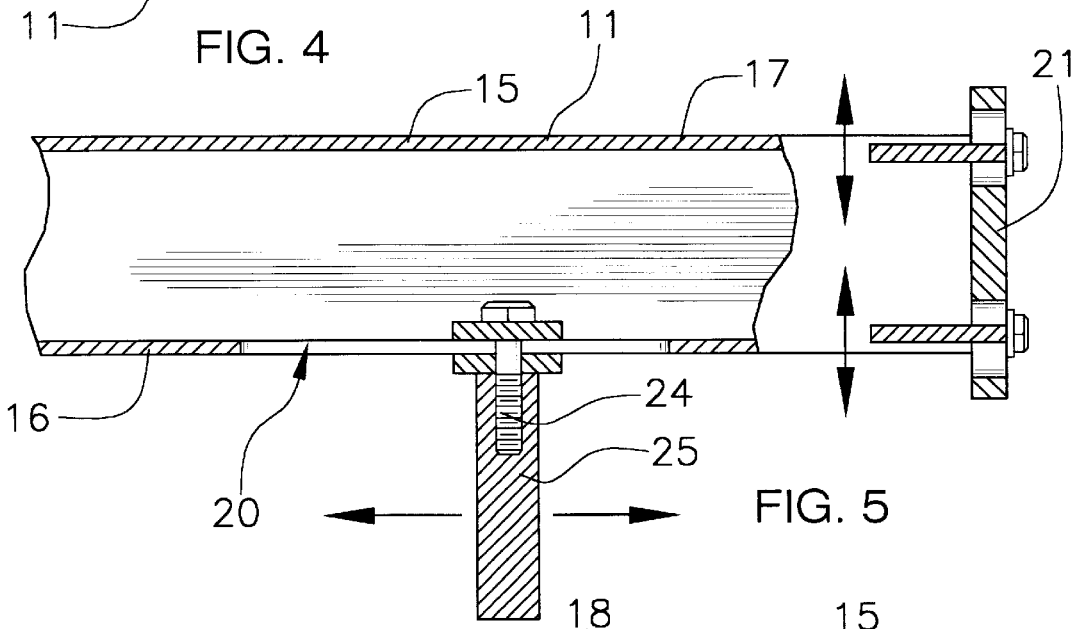
FIG. 5 is a longitudinal cross-sectional view of a lower portion of the of the present invention.
Figure 6:
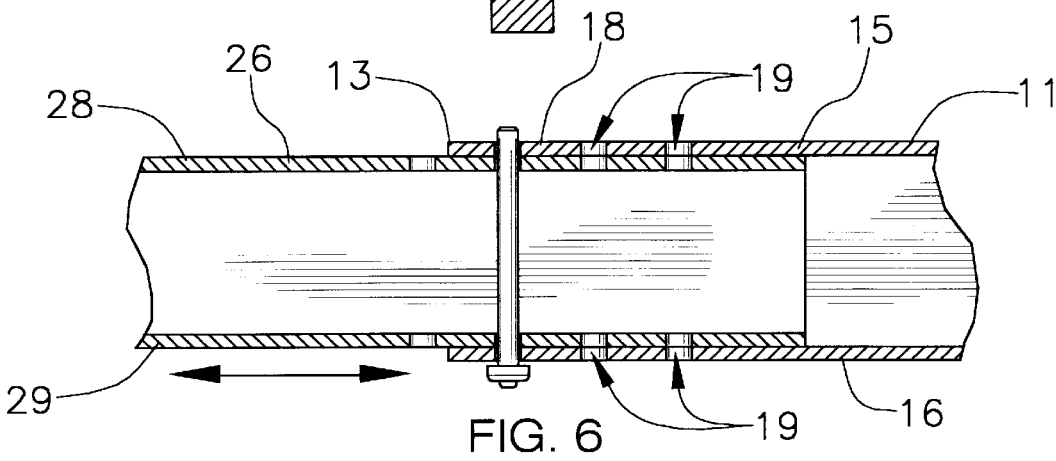
FIG. 6 is a lateral cross-sectional view of leg extension member of the present invention.

With reference now to the drawings, and in particular to FIGS. 1 through 6 thereof, a new body stretching apparatus embodying the principles and concepts of the present invention and generally designated by the reference numeral 10 will be described.

As best illustrated in FIGS. 1 through 6, the body stretching apparatus 10 generally comprises elongate leg support members 11 each having first and second ends 12,13 and also having top and side walls 14–16. Each of the elongate support members 11 is tubular-shaped and has a first portion 17 and a second portion 18, and also has a plurality of holes 19 being spacedly disposed through the side walls 15,16 of the second portion 18 thereof, and further has an elongate slot 20 being disposed through one of the side walls 15,16 of the first portion 17.

Foot support assemblies are conventionally attached to the first ends 12 of the elongate leg support members 11. Each of the foot support assemblies includes a planar pad member 21 being conventionally attached to the first end 12 of a respective elongate leg support member 11 and being disposed perpendicular to a longitudinal axis of the elongate leg support member 11, and also includes foot guide plates 22,23 being adjustably, conventionally and spacedly attached to a topside of the planar pad member 21. The foot guide plates 22,23 are disposed perpendicular to the planar pad member 21 and are movably disposed toward and away from one another to adjust for various widths of users'feet with the foot guide plates 22,23 being adapted to be disposed to either side of the user's foot.

Handhold members 25 are adjustably fastened to the elongate leg support members 11. The handhold members, 25 are adjustably fastened in the elongate slots 20, and include threaded fasteners 24 being disposed through the elongate slots 20, and also include stub shafts 25 with the threaded fasteners 24 being threaded in ends thereof and with the stub shafts 25 being extended outwardly to sides of the elongate leg support members 11.

Leg extension assemblies are adjustably and conventionally fastened with bolts to the elongate leg support members 11 and are hingedly attached to one another. The leg extension assemblies include tubular main sections 26 being adjustably fastened in and extendable from the second ends 13 of the elongate leg support members 11, and also include tubular end sections 30 being hingedly attached to the tubular main sections 26, and further include brackets 34 being conventionally attached to the tubular end sections 30 and being hingedly attached to one another. Each of the tubular main sections 26 has top and side walls 27–29 and also has holes being disposed through the side walls thereof. Each of the tubular end sections 30 has top and side walls 31–33. The elongate leg support members 11 and the tubular main sections 26 are capable of moving upwardly in a direction of the top walls 31 of the tubular end sections 30 to exercise a user's thigh muscles joints. Each of the brackets 34 is conventionally attached and welded to one of the side walls 32,33 of a respective tubular end section 30. The brackets 34 have main portions 35 and eyelet portions 36 being hingedly and conventionally fastened to one another with the tubular end sections 30 being movable from side to side toward and away from one another for a user to exercise one's hamstring muscles.

Knee support assemblies are conventionally fastened to the elongate leg support members 11. The knee support assemblies include first pad support members 37,38 being adjustably and conventionally fastened to the side walls 15,16 of the elongate leg support members 11 and extending upwardly therefrom, and also include first pad members 39 being hingedly and conventionally attached to the first pad support members 37,38 and being spaced above the top walls 14 of the elongate leg support members 11, and further include second pad members 40 being conventionally attached upon the top wall 14 of the elongate leg support members 11 below the first pad members 39, and also include latching straps 41 being conventionally attached to the first pad members 39 and being fastenable upon selected the first pad support members 37,38, and further include fasteners 43 being disposed through the first pad support members 37,38 and through selected holes 19 of the second portions 18 of the elongate leg support members 11 for fastening the first pad support members 37,38 to the elongate leg support members 11.

In use, the user would recline backside upon the elongate leg support members 11 with the user's feet being disposed upon the planar pad members 21 and with the first and second pad members 39,40 being fitted about the user's knees. The user would then be able to lift one's leg upwardly and also conduct scissors-like exercises to build up one's muscles and joints in those regions of the body.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the body stretching apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body stretching apparatus comprising:

elongate leg support members each having first and second ends and also having top and side walls, each of said elongate support members being tubular-shaped and having a first portion and a second portion, and also having a plurality of holes being spacedly disposed through said side walls of said second portion thereof, and further having an elongate slot being disposed through one of said side walls of said first portions;

foot support assemblies being attached to said first ends of said elongate leg support members;

handhold members being adjustably fastened to said elongate leg support members;

leg extension assemblies being adjustable fastened to said elongate leg support members and being hingedly attached to one another; and knee support assemblies being fastened to said elongate leg support members.

2. A body stretching apparatus as described in claim 1, wherein each of said foot support assemblies includes a planar pad member being attached to said first end of a respective said elongate leg support member and being disposed perpendicular to a longitudinal axis of said elongate leg support member, and also includes foot guide plates being adjustably and spacedly attached to a topside of said planar pad member.

3. A body stretching apparatus as described in claim 2, wherein said foot guide plates are disposed perpendicular to said planar pad member and are movably disposed toward and away from one another to adjust for various widths of users'feet, said foot guide plates being adapted to be disposed to either side of the user's foot.

4. A body stretching apparatus as described in claim 3, wherein said handhold members are adjustably fastened in said elongate slots, and include threaded fasteners being disposed through said elongate slots, and also include stub shafts with said threaded fasteners being threaded in ends thereof and with said stub shafts being extended outwardly of said elongate leg support members.

5. A body stretching apparatus as described in claim 1, wherein said leg extension assemblies include tubular main sections being adjustably fastened in and extendable from said second ends of said elongate leg support members, and also include tubular end sections being hingedly attached to said tubular main sections, and further include brackets being attached to said tubular end sections and being hingedly attached to one another.

6. A body stretching apparatus as described in claim 5, wherein each of said tubular main sections has top and side walls and also has holes being disposed through said side walls thereof.

7. A body stretching apparatus as described in claim 6, wherein each of said tubular end sections has top and side walls, said elongate leg support members and said tubular main sections being capable of moving upwardly in a direction of said top walls of said tubular end sections to exercise a user's thigh muscles.

8. A body stretching apparatus as described in claim 7, wherein each of said brackets is attached to one of said side walls of a respective said tubular end section, said brackets having main portions and eyelet portions being hingedly fastened to one another, said tubular end sections being movable from side to side toward and away from one another for a user to exercise one's hamstring muscles.

9. A body stretching apparatus as described in claim 1, wherein said knee support assemblies include first pad support members being adjustably fastened to said side walls of said elongate leg support members and extending upwardly therefrom, and also include first pad members being hingedly attached to said first pad support members and being spaced above said top walls of said elongate leg support members, and further include second pad members being attached upon said top wall of said elongate leg support members below said first pad members, and also include latching straps being attached to said first pad members and being fastenable upon selected said first pad support members, and further include fasteners being disposed through said first pad support members and through selected said holes of said second portions of said elongate leg support members for fastening said first pad support members to said elongate leg support members.

* * * * *